US010012927B2

(12) United States Patent
Tajima et al.

(10) Patent No.: US 10,012,927 B2
(45) Date of Patent: Jul. 3, 2018

(54) DEVELOPING ROLLER INCLUDING ROLLER BODY WITH SIMPLIFIED STRUCTURE WITHOUT A COATING FILM

(71) Applicant: SUMITOMO RUBBER INDUSTRIES, LTD., Kobe-shi, Hyogo (JP)

(72) Inventors: Kei Tajima, Kobe (JP); Yuta Imase, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/679,256

(22) Filed: Aug. 17, 2017

(65) Prior Publication Data

US 2018/0081297 A1 Mar. 22, 2018

(30) Foreign Application Priority Data

Sep. 16, 2016 (JP) ..... 2016-182041

(51) Int. Cl.
*G03G 15/08* (2006.01)

(52) U.S. Cl.
CPC ..... *G03G 15/0808* (2013.01)

(58) Field of Classification Search
CPC ..... G03G 15/0806; G03G 15/0818
USPC ..... 399/286
See application file for complete search history.

(56) References Cited

U.S. PATENT DOCUMENTS

| | | | | |
|---|---|---|---|---|
| 5,733,235 | A | 3/1998 | Waku et al. | |
| 9,075,341 | B2 * | 7/2015 | Kawatani et al. | G03G 15/0818 |
| 9,448,504 | B2 * | 9/2016 | Yoshinaga | G03G 15/0818 |

FOREIGN PATENT DOCUMENTS

| | | | |
|---|---|---|---|
| JP | 5-333753 | A | 12/1993 |
| JP | 8-292640 | A | 11/1996 |
| JP | 2011-257723 | A | 12/2011 |

* cited by examiner

*Primary Examiner* — William J Royer
(74) *Attorney, Agent, or Firm* — Birch, Stewart, Kolasch & Birch, LLP

(57) ABSTRACT

A developing roller is provided, which includes a roller body having a simplified structure without a coating film and yet having a higher wear resistance. The developing roller (1) includes a roller body (2) made of a crosslinked product of a rubber composition containing a rubber component including 20 to 50 parts by mass of ECO and/or GECO as an ion conductive rubber and 50 to 80 parts by mass of NBIR based on 100 parts by mass of the overall rubber component, and an oxide film (6) formed in an outer peripheral surface (5) of the roller body (2) by irradiation with ultraviolet radiation or the like.

6 Claims, 1 Drawing Sheet

DEVELOPING ROLLER INCLUDING ROLLER BODY WITH SIMPLIFIED STRUCTURE WITHOUT A COATING FILM

TECHNICAL FIELD

The present invention relates to a developing roller.

BACKGROUND ART

In an electrophotographic image forming apparatus, an image is generally formed on a surface of a sheet such as a paper sheet or a plastic film through the following process steps.

First, a surface of a photoreceptor body is evenly electrically charged and, in this state, exposed to light, whereby an electrostatic latent image corresponding to an image to be formed on the sheet is formed on the surface of the photoreceptor body (charging step and exposing step).

In turn, toner (minute color particles) preliminarily electrically charged at a predetermined potential is brought into contact with the surface of the photoreceptor body. Thus, the toner selectively adheres to the surface of the photoreceptor body according to the potential pattern of the electrostatic latent image, whereby the electrostatic latent image is developed into a toner image (developing step).

Subsequently, the toner image formed by the development is transferred onto the surface of the sheet (transfer step), and fixed to the surface of the sheet (fixing step). Thus, the image is formed on the surface of the sheet.

Further, toner remaining on the surface of the photoreceptor body after the transfer of the toner image is removed by a cleaning blade or the like kept in abutment against the surface of the photoreceptor body (cleaning step). Thus, the photoreceptor body is ready for the next image formation.

In the developing step out of the aforementioned process steps, a developing roller is used for developing the electrostatic latent image formed on the surface of the photoreceptor body into the toner image.

The developing roller typically includes a roller body produced, for example, by forming an electrically conductive rubber composition into a tubular body and crosslinking the rubber composition of the tubular body.

An ion conductive rubber such as epichlorohydrin rubber is used for a rubber component of the rubber composition in order to impart the roller body with electrical conductivity.

Further, a diene rubber such as acrylonitrile butadiene rubber (NBR) is used in combination with the ion conductive rubber for the rubber component in order to impart the roller body with rubber characteristic properties, i.e., in order to make the roller body flexible and less susceptible to permanent compressive deformation with a smaller compression set.

The outer peripheral surface of the roller body is generally covered with a coating film to be thereby properly conditioned.

The coating film is generally formed by applying a liquid coating agent onto the outer peripheral surface of the roller body by a spraying method, a dipping method or the like and then drying the applied coating agent. Therefore, the coating film is liable to suffer from contamination with dust and other foreign matter during the formation thereof, thickness unevenness and other defects.

For preparation of the coating agent, an organic solvent is required. The use of the organic solvent may exert a great load on the environment, and go against a recent trend toward reduction of VOC (volatile organic compounds).

An oxide film may be formed in the outer peripheral surface of the roller body by irradiation with ultraviolet radiation, thereby obviating the coating film (Patent Document 1).

Where the roller body is produced by using the aforementioned conventional combination of rubbers for the rubber component and has an outer peripheral surface formed with a thin oxide film, the roller body has a lower wear resistance and, therefore, is liable to be significantly worn as the number of times of image formation increases.

Due to wear debris generated by the wear of the roller body, the cleaning blade in abutment against the photoreceptor body is liable to be torn up or reversed as the photoreceptor body is rotated, making it impossible to properly clean the surface of the photoreceptor body. Problematically, this may result in formation of defective images.

CITATION LIST

Patent Document

Patent Document 1: JP2011-257723A

SUMMARY OF THE INVENTION

Problem to be Solved by the Invention

It is an object of the present invention to provide a developing roller which includes a roller body having a simplified structure without a coating film and yet having a higher wear resistance.

Solution to Problem

According to the present invention, there is provided a developing roller, which includes a tubular roller body made of a crosslinked product of a rubber composition, and an oxide film provided in an outer peripheral surface of the roller body, wherein the rubber composition contains a rubber component, and a crosslinking component for crosslinking the rubber component, wherein the rubber component includes not less than 20 parts by mass and not greater than 50 parts by mass of at least one ion conductive rubber selected from the group consisting of an epichlorohydrin-ethylene oxide bipolymer and an epichlorohydrin-ethylene oxide-allyl glycidyl ether terpolymer, and not less than 50 parts by mass and not greater than 80 parts by mass of acrylonitrile butadiene isoprene rubber based on 100 parts by mass of the overall rubber component.

Effects of the Invention

According to the present invention, the developing roller is provided, which includes the roller body having a simplified structure without a coating film and yet having a higher wear resistance.

EMBODIMENTS OF THE INVENTION

Figure 1:
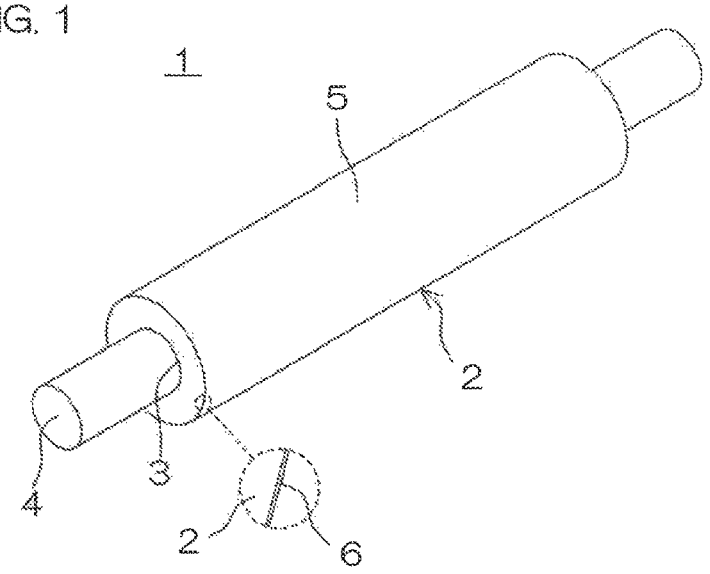
FIG. 1 is a perspective view illustrating an exemplary developing roller according to one embodiment of the present invention.

According to the present invention, a developing roller includes a tubular roller body made of a crosslinked product of a rubber composition, and an oxide film provided in an outer peripheral surface of the roller body. The rubber composition contains a rubber component, and a crosslinking component for crosslinking the rubber component. The rubber component includes not less than 20 parts by mass and not greater than 50 parts by mass of at least one ion conductive rubber selected from the group consisting of an epichlorohydrin-ethylene oxide bipolymer (ECO) and an epichlorohydrin-ethylene oxide-allyl glycidyl ether terpolymer (GECO), and not less than 50 parts by mass and not greater than 80 parts by mass of acrylonitrile butadiene isoprene rubber (NBIR) based on 100 parts by mass of the overall rubber component.

It is known that crosslinked products of natural rubber and isoprene rubber (IR) synthesized as having the same structure as the natural rubber are excellent in wear resistance among other diene rubbers. However, these rubbers are significantly different in polarity from the ECO and the GECO (ion conductive rubbers) and, therefore, are less compatible with the ECO and the GECO. Therefore, it is impossible to homogenously mix these rubbers with the ECO and the GECO even by kneading with heating.

If the ECO and/or the GECO are blended with the IR and further with the NBR, the NBR functions as a compatibilizer. Therefore, these rubbers can be mixed to be homogenized to some extent. Further, the resulting slab has a wear resistance improved to some extent.

However, the mixing homogeneity is still insufficient. In developing roller including a roller body actually produced by using the ECO and/or the GECO, the IR and the NBR as the rubber component has an insufficient wear resistance during repeated image formation. This makes it impossible to sufficiently prevent the roller body from being significantly worn as the number of times of image formation increases, and to prevent defective image formation due to wear debris generated by the wear of the roller body.

On the other hand, the NBIR which is a terpolymer prepared by copolymerizing acrylonitrile and butadiene as repeating units of the NBR and isoprene as a repeating unit of the IR is highly compatible with the ECO and the GECO and, therefore, can be properly homogeneously mixed with the ECO and/or the GECO by kneading with heating.

Where the NBIR is used in combination with the ECO and/or the GECO, isoprene introduced into a main chain of the NBIR functions to significantly improve the wear resistance of the roller body.

Therefore, the roller body has a simplified structure with a thin oxide film formed by irradiation with ultraviolet radiation or the like without the provision of the coating film, and yet can properly suppress the generation of the wear debris and the associated defective image formation.

<<Rubber Composition>>

<Ion Conductive Rubber>

As described above, the ion conductive rubber to be used in the present invention is limited to the ECO and/or the GECO.

Generally known examples of the ion conductive rubber include various epichlorohydrin rubbers containing epichlorohydrin as a repeating unit such as epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers.

However, the aforementioned epichlorohydrin rubbers other than the ECO and the GECO are insufficient in ion conductivity and, when being used in combination with the NBIR, fail to sufficiently reduce the roller resistance of the developing roller to a range suitable for the developing roller.

In contrast, the ECO and/or the GECO each have higher ion conductivity and, when being used in combination with the NBIR, can sufficiently reduce the roller resistance of the developing roller to the range suitable for the developing roller.

(ECO)

The ECO preferably has an ethylene oxide (EO) content of not less than 50 mol % and not greater than 80 mol %.

Ethylene oxide functions to reduce the roller resistance of the developing roller. However, if the ethylene oxide content is less than the aforementioned range, it will be impossible to sufficiently provide this function and hence to sufficiently reduce the roller resistance of the developing roller to the range suitable for the developing roller.

If the ethylene oxide content is greater than the aforementioned range, on the other hand, ethylene oxide is liable to be crystallized, whereby the segment motion of molecular chains is hindered to adversely Increase the roller resistance. Further, the roller body is liable to have an excessively high hardness after the crosslinking, and the rubber composition is liable to have a higher viscosity and, hence, poorer processability when being heat-melted before the crosslinking.

The ECO has an epichlorohydrin (EP) content that is a balance obtained by subtracting the ethylene oxide content from the total. That is, the epichlorohydrin content is preferably not less than 20 mol % and not greater than 50 mol %.

A specific example of the ECO is EPICHLOMER (registered trade name) D available from Osaka Soda Co., Ltd. and having a molar ratio of EO/EP=61/39 not by way of limitation.

(GECO)

The GECO preferably has an ethylene oxide (EO) content of not less than 71 mol % and not greater than 79.5 mol %.

If the ethylene oxide content is less than the aforementioned range, it will be impossible to sufficiently reduce the roller resistance of the developing roller to the range suitable for the developing roller.

If the ethylene oxide content is greater than the aforementioned range, on the other hand, the roller resistance is adversely increased. Further, the roller body is liable to have an excessively high hardness after the crosslinking, and the rubber composition is liable to have a higher viscosity and, hence, poorer processability when being heat-melted before the crosslinking.

The GECO preferably has an allyl glycidyl ether (AGE) content of not less than 0.5 mol % and not greater than 5 mol %.

Allyl glycidyl ether per se functions as side chains of the copolymer to provide a free volume, whereby the crystallization of ethylene oxide is suppressed to reduce the roller resistance of the developing roller. However, if the allyl glycidyl ether content is less than the aforementioned range, it will be impossible to sufficiently provide this function and hence to sufficiently reduce the roller resistance of the developing roller to the range suitable for the developing roller.

Allyl glycidyl ether also functions as crosslinking sites during the crosslinking of the GECO. Therefore, if the allyl glycidyl ether content is greater than the aforementioned range, the crosslinking density of the GECO is excessively increased, whereby the segment motion of molecular chains is hindered to adversely increase the roller resistance.

The GECO has an epichlorohydrin (EP) content that is a balance obtained by subtracting the ethylene oxide content and the allyl glycidyl ether content from the total. That is, the epichlorohydrin content is preferably not less than 20 mol % and not greater than 24 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

A specific example of the GECO is EPION (registered trade name) 301 available from Osaka Soda Co., Ltd. and having a molar ratio of EO/EP/AGE=73/23/4 not by way of limitation.

<NBIR>

Where the acrylonitrile butadiene isoprene rubber (NBIR) is used in combination with the ECO and/or the GECO, as described above, the roller body has a simplified structure with the thin oxide film formed by the irradiation with the ultraviolet radiation or the like without the provision of the coating film, and yet has a significantly improved wear resistance.

Not by way of limitation, specific examples of the NBIR include NIPOL (registered trade name) DN1201 (having a bonded acrylonitrile content of 35.0% (median) and a Mooney viscosity of 77.5 (median)) and DN1201L (having a bonded acrylonitrile content of 35.0% (median) and a Mooney viscosity of 46 (median)) available from Nippon Zeon Corporation, at least one of which may be used.

<Other Diene Rubber>

For improvement of the wear resistance of the roller body, only the NBIR is preferably used as the diene rubber. However, other diene rubber may be additionally used, as long as the aforementioned effect of the use of the NBIR is not impaired.

Other examples of the diene rubber include butadiene rubber (BR), NBR, styrene butadiene rubber (SBR), chloroprene rubber (CR) and ethylene propylene diene rubber (EPDM), which may be used alone or in combination.

(BR)

Usable as the BP are various crosslinkable BRs each having a polybutadiene structure in a molecule thereof.

Particularly, a higher cis-content BR having a cis-1,4 bond content of not less than 95% and excellent rubber characteristic properties in a temperature range from a higher temperature to a lower temperature is preferred.

The BRs include those of an oil-extension type having flexibility controlled by addition of an extension oil, and those of a non-oil-extension type containing no extension oil. In the present invention, a non-oil-extension type BR which does not contain the extension oil (which may be a bleed substance) is preferably used for prevention of the contamination of the photoreceptor body.

These BRs may be used alone or in combination.

(NBR)

The NBR may be classified in a lower acrylonitrile content type having an acrylonitrile content of not greater than 24%, an intermediate acrylonitrile content type having an acrylonitrile content of 25 to 30%, an intermediate to higher acrylonitrile content type having an acrylonitrile content of 31 to 35%, a higher acrylonitrile content type having an acrylonitrile content of 36 to 42%, or a very high acrylonitrile content type having an acrylonitrile content of not lower than 43%. Any of these types of NBRs is usable.

The NBRs include those of an oil-extension type having flexibility controlled by addition of an extension oil, and those of a non-oil-extension type containing no extension oil. In the present invention, a non-oil-extension type NBR is preferably used for prevention of the contamination of the photoreceptor body.

These NBRs may be used alone or in combination.

(SBR)

Usable as the SBR are various SBRs synthesized by copolymerizing styrene and 1,3-butadiene by an emulsion polymerization method, a solution polymerization method and other various polymerization methods.

According to the styrene content, the SBRs are classified into a higher styrene content type, an intermediate styrene content type and a lower styrene content type, and any of these types of SBRs is usable.

The SBRs include those of an oil-extension type having flexibility controlled by addition of an extension oil, and those of a non-oil-extension type containing no extension oil. In the present invention, a non-oil-extension type SBR is preferably used for prevention of the contamination of the photoreceptor body.

These SBRs may be used alone or in combination.

(CR)

The CR is synthesized, for example, by emulsion polymerization of chloroprene, and may be classified in a sulfur modification type or a non-sulfur-modification type depending on the type of a molecular weight adjusting agent to be employed for the emulsion polymerization.

The sulfur modification type CR is prepared by plasticizing a copolymer of chloroprene and sulfur (molecular weight adjusting agent) with thiuram disulfide or the like to adjust the viscosity of the copolymer to a predetermined viscosity level.

The non-sulfur-modification type CR may be classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent.

The xanthogen modification type CR is synthesized in substantially the same manner as the sulfur modification type CR, except that an alkyl xanthogen compound is used as the molecular weight adjusting agent.

Further, the CR may be classified in a lower crystallization speed type, an intermediate crystallization speed type or a higher crystallization speed type depending on the crystallization speed.

In the present invention, any of the aforementioned types of CRs may be used. Particularly, a CR of the non-sulfur-modification type and the lower crystallization speed type is preferred.

Further, a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used alone or in combination.

The CRs include those of an oil-extension type having flexibility controlled by addition of an extension oil, and those of a non-oil-extension type containing no extension oil. In the present invention, a non-oil-extension type CR is preferably used for prevention of the contamination of the photoreceptor body.

These CRs may be used alone or in combination.

(EPDM)

Usable as the EPDM are various copolymers prepared by copolymerizing ethylene, propylene and a diene. Typical examples of the diene include ethylidene norbornene (ENB) and dicyclopentadiene (DCPD).

Further, a hydrogenated nitrile rubber (HNBR) prepared by controlling the amount of double bonds remaining in a main chain through a hydrogenation reaction is also usable as the EPDM.

The EPDMs include those of an oil-extension type having flexibility controlled by addition of an extension oil, and those of a non-oil-extension type containing no extension oil. In the present invention, a non-oil-extension type EPDM is preferably used for prevention of the contamination of the photoreceptor body.

These EPDMs may be used alone or in combination.

<Proportions of Rubbers to be Blended>

As previously described, the proportion of the ECO and/or the GECO to be blended as the ion conductive rubber should be not less than 20 parts by mass and not greater than 50 parts by mass based on 100 parts by mass of the overall rubber component.

If the proportion of the ion conductive rubber is less than the aforementioned range, it will be impossible to sufficiently reduce the roller resistance of the developing roller to the range suitable for the developing roller.

The ECO and/or the GECO as the ion conductive rubber have no double bond in their main chains and, therefore, function to increase the resistance to ozone which is generated particularly when the outer peripheral surface of the roller body is irradiated with ultraviolet radiation in an oxidizing atmosphere for formation of the oxide film in the outer peripheral surface (ultraviolet radiation having a wavelength of not greater than 200 nm is the main cause of the generation of ozone). If the proportion of the ion conductive rubber is less than the aforementioned range, however, this function will be insufficient, so that the outer peripheral surface of the roller body is liable to be deteriorated by the ozone to be thereby cracked.

If the proportion of the ion conductive rubber is greater than the aforementioned range, on the other hand, the proportion of the NBIR is relatively reduced, making it impossible to provide the effect of the NBIR for improving the wear resistance of the roller body. Therefore, the roller body is liable to be significantly worn as the number of times of the image formation increases. Further, the wear debris generated by the wear is liable to cause the defective image formation.

Where the proportion of the ion conductive rubber falls within the aforementioned range, in contrast, it is possible to sufficiently reduce the roller resistance of the developing roller to the range suitable for the developing roller without reduction in the wear resistance of the roller body and the cracking of the outer peripheral surface of the roller body.

The proportion of the NBIR to be blended should be not less than 50 parts by mass and not greater than 80 parts by mass based on 100 parts by mass of the overall rubber component.

If the proportion of the NBIR is less than the aforementioned range, it will be impossible to provide the effect of the use of the NBIR for improving the wear resistance of the roller body. Therefore, the roller body is liable to be significantly worn as the number of times of the image formation increases. Further, the wear debris generated by the wear is liable to cause the defective image formation.

If the proportion of the NBIR is greater than the aforementioned range, on the other hand, the outer peripheral surface of the roller body is liable to be cracked. Further, the proportion of the ion conductive rubber is relatively reduced, making it impossible to reduce the roller resistance of the developing roller to the range suitable for the developing roller.

Where the proportion of the NBIR falls within the aforementioned range, in contrast, it is possible to sufficiently reduce the roller resistance of the developing roller to the range suitable for the developing roller and to improve the wear resistance of the roller body while preventing the cracking of the developing roller.

Where a diene rubber other than the NBIR is used, the proportion of the other diene rubber is preferably not greater than 30 parts by mass based on 100 parts by mass of the overall rubber component.

If the proportion of the other diene rubber is greater than the aforementioned range, the proportion of the ion conductive rubber is relatively reduced, making it impossible to sufficiently reduce the roller resistance of the developing roller to the range suitable for the developing roller. Further, the proportion of the NBIR is relatively reduced, thereby reducing the wear resistance of the roller body.

Where the proportion of the other diene rubber falls within the aforementioned range, in contrast, it is possible to provide the aforementioned effect of the combinational use of the ECO and/or the GECO and the NBIR for sufficiently reducing the roller resistance of the developing roller to the range suitable for the developing roller and improving the wear resistance of the roller body.

The lower limit of the proportion of the other diene rubber is not particularly defined. As described above, it is preferred that the other diene rubber is not blended, i.e., the proportion of the other diene rubber is 0 part by mass, for further improvement of the effect of the combinational use of the ECO and/or the GECO and the NBIR.

<Crosslinking Component>

A sulfur crosslinking component and at least one selected from the group consisting of a thiourea crosslinking agent and a triazine crosslinking agent are preferably used in combination as the crosslinking component.

(Thiourea Crosslinking Agent)

Various thiourea compounds each having a thiourea structure in a molecule thereof and functioning as a crosslinking agent for the ECO and/or the GECO are usable as the thiourea crosslinking agent.

Examples of the thiourea crosslinking agent include ethylene thiourea (also referred to as 2-mercaptoimidazoline), diethylthiourea and dibutylthiourea, which may be used alone or in combination. Particularly, ethylene thiourea is preferred.

The proportion of the thiourea crosslinking agent to be blended is preferably not less than 0.3 parts by mass and not greater than 1 part by mass based on 100 parts by mass of the overall rubber component.

If the proportion of the thiourea crosslinking agent is less than the aforementioned range, the crosslinking of the ECO and/or the GECO will be insufficient, so that the roller body is liable to have an increased compression set to suffer from the permanent compressive deformation.

If the proportion of the thiourea crosslinking agent is greater than the aforementioned range, on the other hand, the roller body is liable to have an excessively high hardness after the crosslinking and, hence, have poorer imaging durability. Therefore, the developing roller is liable to cause a so-called fogging defect, i.e., adhesion of toner to a margin of a formed image, when the image formation is repeated.

That is, a very small part of toner contained in a developing section of an image forming apparatus is used in each image forming cycle, and the remaining major part of the toner is repeatedly circulated in the developing section.

Therefore, if the developing roller provided in the developing section is excessively hard, the toner is liable to be damaged when being repeatedly brought into contact with the developing roller in the repeated image formation.

If the percentage of the toner damaged to be broken into particles is increased, the chargeability of the broken toner particles is significantly deviated from that of normal toner, so that the toner is more liable to adhere to the margin of the formed image to cause the fogging.

Further, if the proportion of the thiourea crosslinking agent is greater than the aforementioned range, an excess amount of the thiourea crosslinking agent is liable to bloom on the outer peripheral surface of the roller body to thereby hinder the formation of the oxide film in the outer peripheral surface by the irradiation with the ultraviolet radiation or the like and contaminate the photoreceptor body.

(Crosslinking Accelerating Agent)

A crosslinking accelerating agent may be used in combination with the thiourea crosslinking agent for accelerating the crosslinking of the ECO and/or the GECO with the thiourea crosslinking agent.

Examples of the crosslinking accelerating agent include guanidine accelerating agents such as 1,3-diphenylguanidine (D), 1,3-di-o-tolylguanidine (DT) and 1-o-tolylbiguanide (BG), which may be used alone or in combination.

The proportion of the crosslinking accelerating agent to be blended is preferably not less than 0.3 parts by mass and not greater than 1 part by mass based on 100 parts by mass of the overall rubber component in order to sufficiently provide the effect of the crosslinking accelerating agent for accelerating the crosslinking of the ECO and/or the GECO.

(Triazine Crosslinking Agent)

Various triazine compounds each having a triazine structure in a molecule thereof and functioning as a crosslinking agent for the ECO and/or the GECO are usable as the triazine crosslinking agent.

Examples of the triazine crosslinking agent include 2,4,6-trimercapto-s-triazine, 2-anilino-4,6-dimercapto-s-triazine and 2-dibutylamino-4,6-dimercapto-s-triazine, which may be used alone or in combination.

The proportion of the triazine crosslinking agent to be blended is preferably not less than 0.5 parts by mass and not greater than 3.0 parts by mass based on 100 parts by mass of the overall rubber component.

If the proportion of the triazine crosslinking agent is less than the aforementioned range, the crosslinking of the ECO and/or the GECO will be insufficient, so that the roller body is liable to have an increased compression set to suffer from the permanent compressive deformation.

If the proportion of the triazine crosslinking agent is greater than the aforementioned range, on the other hand, the roller body is liable to have an excessively high hardness after the crosslinking and, hence, have poorer imaging durability to cause the fogging defect. Further, an excess amount of the triazine crosslinking agent is liable to bloom on the outer peripheral surface of the roller body to hinder the formation of the oxide film in the outer peripheral surface by the irradiation with the ultraviolet radiation or the like and contaminate the photoreceptor body.

(Sulfur Crosslinking Component)

A sulfur crosslinking agent and a sulfur-containing crosslinking accelerating agent are preferably used in combination as the sulfur crosslinking component for mainly crosslinking the diene rubber.

Examples of the sulfur crosslinking agent include sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine. Particularly, the sulfur is preferred.

The proportion of the sulfur to be blended is preferably not less than 1 part by mass and not greater than 2 parts by mass based on 100 parts by mass of the overall rubber component.

If the proportion of the sulfur is less than the aforementioned range, it will be impossible to properly crosslink the diene rubber to impart the roller body with excellent rubber character is tic properties, i.e., to make the roller body flexible and less susceptible to the permanent compressive deformation with a reduced compression set.

If the proportion of the sulfur is greater than the aforementioned range, on the other hand, an excess amount of the sulfur is liable to blood on the outer peripheral surface of the roller body to hinder the formation of the oxide film in the outer peripheral surface by the irradiation with the ultraviolet radiation or the like and contaminate the photoreceptor body.

Where the oil-treated sulfur powder, the dispersive sulfur or the like is used as the sulfur, for example, the proportion of the sulfur is defined as the effective proportion of sulfur contained therein.

Where the organic sulfur-containing compound is used as the crosslinking agent, the proportion of the organic sulfur-containing crosslinking agent is preferably adjusted so that the proportion of sulfur contained in molecules of the organic sulfur-containing crosslinking agent falls within the aforementioned range based on 100 parts by mass of the overall rubber component.

Examples of the sulfur-containing crosslinking accelerating agent include a thiazole accelerating agent, a thiuram accelerating agent, a sulfenamide accelerating agent and a dithiocarbamate accelerating agent, which may be used alone or in combination. Among these crosslinking accelerating agents, the thiazole accelerating agent and the thiuram accelerating agent are preferably used in combination.

Examples of the thiazole accelerating agent include 2-mercaptobenzothiazole (M), di-2-benzothiazolyl disulfide (DM), a zinc salt of 2-mercaptobenzothiazole (MZ), a cyclohexylamine salt of 2-mercaptobenzothiazole (HM, M60-OT), 2-(N,N-diethylthiocarbamoylthio)benzothiazole (64) and 2-(4'-morpholinodithio)benzothiazole (DS, MDB), which may be used alone or in combination. Particularly, di-2-benzothiazolyl disulfide (DM) is preferred.

Examples of the thiuram accelerating agent include tetramethylthiuram monosulfide (TS), tetramethylthiuram disulfide (TT, TMT), tetraethylthiuram disulfide (TET), tetrabutylthiuram disulfide (TBT), tetrakis(2-ethylhexyl)thiuram disulfide (TOT-N) and dipentamethylenethiuram tetrasulfide (TRA), which may be used alone or in combination. Particularly, tetramethylthiuram monosulfide (TS) is preferred.

Where the two types of crosslinking accelerating agents are used in combination, the proportion of the thiazole accelerating agent to be blended is preferably not less than 1 part by mass and not greater than 2 parts by mass based on 100 parts by mass of the overall rubber component, and the proportion of the thiuram accelerating agent to be blended is preferably not less than 0.3 parts by mass and not greater than 1 part by mass based on 100 parts by mass of the overall rubber component in order to sufficiently provide the effect of these accelerating agents for accelerating the crosslinking of the diene rubber.

<Electrically Conductive Agent>

The rubber composition may further contain a salt (ion salt) containing an anion having a fluoro group and a sulfonyl group and a cation in its molecule as an electrically conductive agent.

With the use of the ion salt as the electrically conductive agent, the rubber composition is further improved in ion conductivity, thereby further reducing the roller resistance of the developing roller.

Examples of the anion having the fluoro group and the sulfonyl group in the molecule of the ion salt include fluoroalkyl sulfonate ions, bis(fluoroalkylsulfonyl)imide ions and tris(fluoroalkylsulfonyl)methide ions, which may be used alone or in combination.

Examples of the fluoroalkyl sulfonate ions include $CF_3SO_3^-$ and $C_4F_9SO_3^-$, which may be used alone or in combination.

Examples of the bis(fluoroalkylsulfonyl)imide ions include $(CF_3SO_2)N^-$, $(C_2F_5SO_2)_2N^-$, $(C_4F_9SO_2)(CF_3SO_2)N^-$, $(FSO_2C_6F_4)(CF_3SO_2)N^-$, $(C_8F_{17}SO_2)(CF_3SO_2)N^-$, $(CF_3CH_2OSO_2)_2N^-$, $(CF_3CF_2CH_2OSO_2)_2N^-$, $(HCF_2CF_2CH_2OSO_2)_2N^-$ and $[(CF_3)_2CHOSO_2]_2N^-$, which may be used alone or in combination.

Examples of the tris (fluoroalkylsulfonyl)methide ions include $(CF_3SO_2)_3C^-$ and $(CF_3CH_2OSO_2)_3C^-$, which may be used alone or in combination.

Examples of the cation include ions of alkali metals such as sodium, lithium and potassium, ions of Group II elements such as beryllium, magnesium, calcium, strontium and barium, ions of transition elements, cations of amphoteric elements, a quaternary ammonium ion and an imidazolium cation, which may be used alone or in combination.

Particularly, lithium salts containing the lithium ion as the cation and potassium salts containing the potassium ion as the cation are preferred as the ion salt.

Among these ion salts, $(CF_3SO_2)_2NLi$ (lithium bis (trifluoromethanesulfonyl)imide) and/or $(CF_3SO_2)_2NK$ (potassium bis(trifluoromethanesulfonyl)imide) are preferred for improvement of the ion conductivity of the rubber composition for reduction of the roller resistance of the developing roller.

The proportion of the ion salt to be blended is preferably not less than 0.5 parts by mass and not greater than 5 parts by mass, particularly preferably not less than 0.8 parts by mass and not greater than 2 parts by mass, based on 100 parts by mass of the overall rubber component.

If the proportion of the ion salt is less than the aforementioned range, it will be impossible to sufficiently provide the effect of the ion salt for improving the ion conductivity of the rubber composition to reduce the roller resistance of the developing roller.

If the proportion of the ion salt is greater than the aforementioned range, on the other hand, the intended effect will not be further enhanced, but an excess amount of the ion salt is liable to bloom on the outer peripheral surface of the roller body to hinder the formation of the oxide film in the outer peripheral surface by the irradiation with the ultraviolet radiation or the like and contaminate the photoreceptor body.

<Other Ingredients>

As required, various additives may be added to the rubber composition. Examples of the additives include a crosslinking acceleration assisting agent, an acid accepting agent and a filler.

Examples of the crosslinking acceleration assisting agent include metal compounds such as zinc oxide (zinc white), fatty acids such as stearic acid, oleic acid and cotton seed fatty acids, and other conventionally known crosslinking acceleration assisting agents, which may be used alone or in combination.

The proportions of these crosslinking acceleration assisting agents to be added are preferably each not less than 0.1 part by mass and not greater than 7 parts by mass based on 100 parts by mass of the overall rubber component.

In the presence of the acid accepting agent, chlorine-containing gases generated from the ECO and/or the GECO during the crosslinking are prevented from remaining in the roller body. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be added is preferably not less than 0.1 part by mass and not greater than 7 parts by mass based on 100 parts by mass of the overall rubber component.

If the proportion of the acid accepting agent is less than the aforementioned range, it will be impossible to sufficiently provide the effect of the addition of the acid accepting agent. If the proportion of the acid accepting agent is greater than the aforementioned range, the roller body is liable to have an excessively high hardness after the crosslinking and, hence, have poorer imaging durability to cause the fogging defect.

Examples of the filler include zinc oxide, silica, carbon black, clay, talc, calcium carbonate, magnesium carbonate and aluminum hydroxide, which may be used alone or in combination.

The addition of the filler improves the mechanical strength and the like of the developing roller.

Where electrically conductive carbon black is used as the filler, the roller body is imparted with electron conductivity.

A preferred example of the electrically conductive carbon black is HAF black. The HAF black can be homogenously dispersed in the rubber composition and, therefore, impart the roller body with more uniform electron conductivity.

The proportion of the electrically conductive carbon black to be added is preferably not less than 1 part by mass and not greater than 5 parts by mass based on 100 parts by mass of the overall rubber component.

Other examples of the additives include a degradation preventing agent, an anti-scorching agent, a plasticizing agent, a lubricant, a pigment, an anti-static agent, a flame retarder, a neutralizing agent, a nucleating agent and a co-crosslinking agent, which may be blended in proper proportions.

<<Developing Roller>>

FIG. 1 is a perspective view illustrating an exemplary developing roller according to one embodiment of the present invention.

Referring to FIG. 1, the developing roller 1 according to this embodiment includes a tubular roller body 2 of a nonporous single-layer structure formed from the rubber composition containing the aforementioned ingredients, and a shaft 4 is inserted through and fixed to a center through-hole 3 of the roller body 2.

The shaft 4 is a unitary member made of a metal such as aluminum, an aluminum alloy or a stainless steel.

The shaft 4 is electrically connected to and mechanically fixed to the roller body 2, for example, via an electrically conductive adhesive agent. Alternatively, a shaft having an outer diameter that is greater than the inner diameter of the through-hole 3 is used as the shaft 4, and press-inserted into the through-hole 3 to be electrically connected to and mechanically fixed to the roller body 2.

The roller body 2 has an oxide film 6 provided in an outer peripheral surface 5 thereof as shown in FIG. 1 on an enlarged scale.

The oxide film 6 thus provided functions as a dielectric layer to reduce the dielectric dissipation factor of the developing roller 1. Further, the oxide film 6 serves as a lower friction layer which advantageously suppresses the adhesion of the toner.

In addition, the oxide film 6 can be easily formed through oxidation of the diene rubber such as the NBIR contained in the rubber composition in the outer peripheral surface 5, for example, by irradiating the outer peripheral surface 5 with ultraviolet radiation in an oxidizing atmosphere. This suppresses reduction in the productivity of the developing roller 1 and the increase in the production costs of the developing roller 1.

The term "single-layer structure" of the developing roller 1 means that the developing roller 1 includes a single rubber layer and the oxide film 6 formed by the irradiation with the ultraviolet radiation or the like is not counted.

For production of the developing roller 1, the prepared rubber composition is first extruded into a tubular body by means of an extruder. Then, the tubular body is cut to a predetermined length, and the rubber composition of the tubular body is crosslinked in a vulcanization can by pressure and heat.

In turn, the crosslinked tubular body is heated in an oven or the like for secondary crosslinking, then cooled, and polished to a predetermined outer diameter. Thus, the roller body 2 is produced.

Various polishing methods such as a dry traverse polishing method may be used for the polishing.

The outer peripheral surface 5 of the roller body 2 may be mirror-finished at the final stage of the polishing process. In this case, the mirror-finishing further improves the releasability of the outer peripheral surface 5 and, synergistically with the formation of the oxide film 6, further advantageously suppresses the adhesion of the toner to the outer peripheral surface 5. This effectively prevents the contamination of the photoreceptor body and the like.

The shaft 4 may be inserted through and fixed to the through-hole 3 at any time between the end of the cutting of the tubular body and the end of the polishing.

However, it is preferred to carry out the secondary crosslinking and the polishing with the shaft 4 inserted through the through-hole 3 after the cutting. This suppresses the warpage and the deformation of the roller body 2, which may otherwise occur due to the expansion and the contraction of the tubular body during the secondary crosslinking. Further, the roller body 2 may be polished while being rotated about the shaft 4. This improves the working efficiency in the polishing, and suppresses the deflection of the outer peripheral surface 5.

As previously described, the shaft 4 having an outer diameter greater than the inner diameter of the through-hole 3 may be press-inserted into the through-hole 3, or the shaft 4 may be inserted through the through-hole 3 of the tubular body with the intervention of an electrically conductive thermosetting adhesive agent between the shaft 4 and the tubular body before the secondary crosslinking.

In the former case, the electrical connection and the mechanical fixing are achieved simultaneously with the press insertion of the shaft 4.

In the latter case, the thermosetting adhesive agent is cured when the tubular body is heated in the oven for the secondary crosslinking, whereby the shaft 4 is electrically connected to and mechanically fixed to the roller body 2.

As described above, the formation of the oxide film 6 is preferably achieved by the irradiation of the outer peripheral surface 5 of the roller body 2 with the ultraviolet radiation. That is, this method is simple and efficient, because the formation of the oxide film 6 is achieved simply through the oxidation of the NBIR and the like of the rubber composition present in the outer peripheral surface 5 of the roller body 2 by irradiating the outer peripheral surface 5 with ultraviolet radiation having a predetermined wavelength for a predetermined period.

In addition, the oxide film 6 formed by the irradiation with the ultraviolet radiation is free from the problems associated with the conventional coating film formed by applying the coating agent, and is highly uniform in thickness, and ensures tight adhesion thereof to the roller body 2.

The wavelength of the ultraviolet radiation to be used for the irradiation is preferably not less than 100 nm and not greater than 400 nm, particularly preferably not greater than 300 nm, for efficient oxidation of the NBIR and the like of the rubber composition for the formation of the oxide film 6 excellent in the aforementioned functions. The irradiation period is preferably not shorter than 30 seconds and not longer than 30 minutes, particularly preferably not shorter than 1 minute and not longer than 15 minutes.

The oxide film 6 may be formed by other methods.

The roller body 2 of the developing roller 1 having a nonporous single-layer structure preferably has a type-A durometer hardness of not lower than 52 and not higher than 56.

If the type-A durometer hardness is lower than the aforementioned range, the roller body 2 is liable to have a greater compression set to suffer from the permanent compressive deformation.

If the type-A durometer hardness is higher than the aforementioned range, on the other hand, the roller body 2 is liable to have an excessively high hardness and, hence, have poorer imaging durability to cause the fogging defect.

Where the type-A durometer hardness falls within the aforementioned range, in contrast, the roller body 2 is less susceptible to the permanent compressive deformation with a smaller compression set, so that the developing roller 1 is substantially free from the fogging defect with excellent imaging durability.

The developing roller 1 preferably has a roller resistance of not greater than $10^7\Omega$, which is suitable for use as the developing roller 1.

In order to control the type-A durometer hardness and the roller resistance within the aforementioned ranges, the types and the proportions of the ingredients described above may be properly changed within the aforementioned ranges.

In the present invention, the type-A durometer hardness of the roller body 2 and the roller resistance of the developing roller 1 are measured in an ordinary temperature and ordinary humidity environment at a temperature of 23° C. at a relative humidity of 55% by the following measurement methods.

<Measurement of Type-A Durometer Hardness>

Opposite end portions of the shaft 4 projecting from opposite ends of the roller body 2 are fixed to a support base. In this state, an indenter point of a type-A durometer conforming to Japanese Industrial Standards JIS K6253-3: 2012 is pressed against a widthwise middle portion of the roller body 2 from above, and the type-A durometer hardness of the roller body 2 is measured with a load of 1 kg for a measurement period of 3 seconds (standard measurement period for vulcanized rubber).

<Measurement of Roller Resistance>

Figure 2:
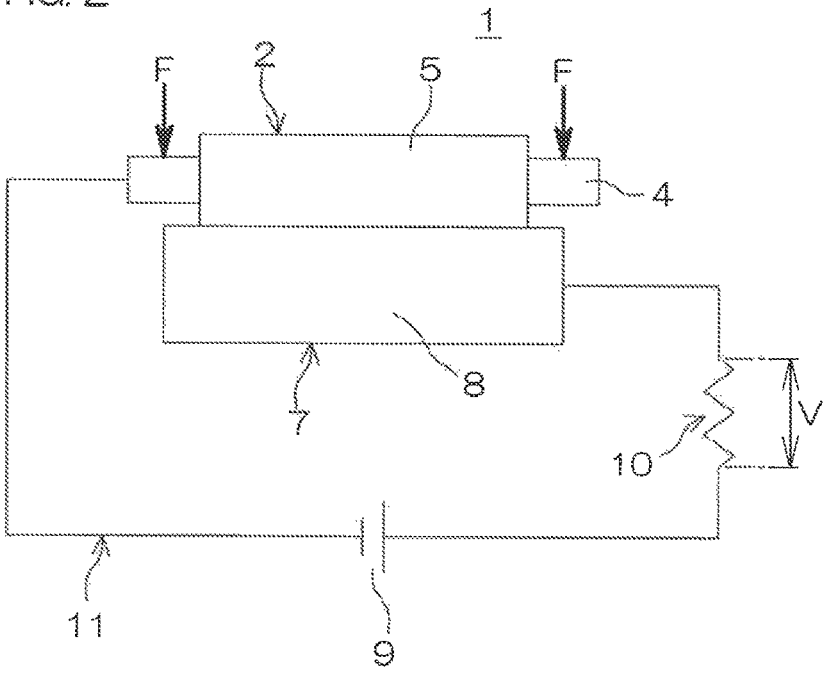
FIG. 2 is a diagram for explaining how to measure the roller resistance of the developing roller.

FIG. 2 is a diagram for explaining how to measure the roller resistance of the developing roller 1.

Referring to FIGS. 1 and 2, an aluminum drum 7 rotatable at a constant rotation speed is prepared, and the outer peripheral surface 5 of the roller body 2 of the developing roller 1 is brought into contact with an outer peripheral surface 8 of the aluminum drum 7 from above.

A DC power source 9 and a resistor 10 are connected in series between the shaft 4 of the developing roller 1 and the aluminum drum 7 to provide a measurement circuit 11. The DC power source 9 is connected to the shaft 4 at its negative terminal, and connected to the resistor 10 at its positive terminal. The resistor 10 has a resistance r of 100Ω.

Subsequently, a load F of 450 g is applied to each of opposite end portions of the shaft 4 to bring the roller body 2 into press contact with the aluminum drum 7 and, in this state, a detection voltage V applied to the resistor 10 is measured by applying an application voltage E of DC 100 V from the DC power source 9 between the shaft 4 and the aluminum drum 7 while rotating the aluminum drum 7 (at a rotation speed of 40 rpm).

The roller resistance R of the developing roller 1 is basically determined from the following expression (i') based on the detection voltage V and the application voltage E (=100 V):

$$R=r\times E/(V-r) \quad \text{(i')}$$

However, the term −r in the expression (i') is negligible, so that the roller resistance of the developing roller 1 is determined from the following expression (i) in the present invention:

$$R=r\times E/V \quad \text{(i)}$$

The inventive developing roller may be incorporated in various electrophotographic image forming apparatuses such as a laser printer, an electrostatic copying machine, a plain paper facsimile machine and a printer-copier-facsimile multifunction machine.

EXAMPLES

Example 1

(Preparation of Rubber Composition)

A rubber component was prepared by blending 30 parts by mass of ECO (EPICHLOMER (registered trade name) D available from Osaka Soda Co., Ltd. and having a molar ratio of EO/EP=61/39) and 70 parts by mass of NBIR (NIPOL (registered trade name) DN1201L available from Nippon Zeon Corporation and having an acrylonitrile content of 35.0% (median) and a Mooney viscosity of 46 (median)).

While 100 parts by mass of the rubber component was simply kneaded by means of a 10-L kneader, 1 part by mass of potassium bis (trifluoromethanesulfonyl)imide (electrically conductive agent EF-N112 available from Mitsubishi Materials Electronic Chemicals Co., Ltd.), 2 parts by mass of carbon black (HAF SEAST 3 (trade name) available from Tokai Carbon Co., Ltd.), 5 parts by mass of zinc oxide type-2 (crosslinking acceleration assisting agent available from Mitsui Mining & Smelting Co., Ltd.) and 5 parts by mass of hydrotalcites (acid accepting agent DHT-4A (registered trade name) 2 available from Kyowa Chemical Industry Co., Ltd.) were added to and kneaded with the rubber component.

While the resulting mixture was continuously kneaded, the following crosslinking component was further added to and kneaded with the mixture. Thus, a rubber composition was prepared. The proportions of the ECO and the NBIR were 30 parts by mass and 70 parts by mass, respectively, based on 100 parts by mass of the overall rubber component.

TABLE 1

| Ingredients | Parts by mass |
|---|---|
| Sulfur powder | 1.50 |
| Accelerating agent DM | 1.50 |
| Accelerating agent TS | 0.50 |
| Thiourea crosslinking agent | 0.60 |
| Accelerating agent DT | 0.54 |

The ingredients shown in Table 1 are as follows. The amounts (parts by mass) of the ingredients shown in Table 1 are based on 100 parts by mass of the overall rubber component.

Sulfur powder: Crosslinking agent (Tsurumi Chemical Industry Co., Ltd.)

Accelerating agent DM: Di-2-benzothiazolyl disulfide (thiazole accelerating agent NOCCELER (registered trade name) DM available from Ouchi Shinko Chemical Industrial Co., Ltd.)

Accelerating agent TS: Tetramethylthiuram monosulfide (thiuram accelerating agent NOCCELER TS available from Ouchi Shinko Chemical Industrial Co., Ltd.)

Thiourea crosslinking agent: Ethylene thiourea (2-mercaptoimidazoline ACCEL (registered trade name) 22-S available from Kawaguchi Chemical Industry Co., Ltd.)

Accelerating agent DT: 1,3-di-o-tolylguanidine (guanidine accelerating agent NOCCELER DT available from Ouchi Shinko Chemical Industrial Co., Ltd.)

(Production of Developing Roller)

The rubber composition thus prepared was fed into a ϕ60 extruder, and extruded into a tubular body having an inner diameter of 5.0 mm and an outer diameter of 13.0 mm. Then, the tubular body was fitted around a temporary crosslinking shaft, and the rubber composition of the tubular body was crosslinked in a vulcanization can at 160° C. for 30 minutes.

Then, the crosslinked tubular body was removed from the temporary shaft, then fitted around a metal shaft having an outer diameter of 6 mm and an outer peripheral surface to which an electrically conductive thermosetting adhesive agent (polyamide adhesive agent) was applied, and heated in an oven at 150° C. for 60 minutes. Thus, the tubular body was bonded to the shaft. Thereafter, opposite end portions of the tubular body were cut, and the outer peripheral surface of the resulting tubular body was dry-polished to an outer diameter of 11.5 mm by means of a wide polishing machine. Thus, a roller body was produced.

After the outer peripheral surface of the roller body thus produced was wiped with alcohol, the roller body was set in a UV irradiation apparatus (PL21-200 available from Sen Lights Corporation) with the outer peripheral surface spaced 50 mm from a UV lamp. The roller body was irradiated with ultraviolet radiation at wavelengths of 185 nm and 245 nm for 5 minutes while being rotated about the shaft at 30 rpm. Thus, an oxide film was formed in the outer peripheral surface of the roller body. In this manner, a developing roller was produced.

Example 2

A rubber composition was prepared and a developing roller was produced in substantially the same manner as in Example 1, except that the proportion of the ECO was 50 parts by mass and the proportion of the NBIR was 50 parts by mass. The proportions of the ECO and the NBIR were 50 parts by mass and 50 parts by mass, respectively, based on 100 parts by mass of the overall rubber component.

Example 3

A rubber composition was prepared and a developing roller was produced in substantially the same manner as in Example 1, except that the proportion of the ECO was 20 parts by mass and the proportion of the NBIR was 80 parts by mass. The proportions of the ECO and the NBIR were 20 parts by mass and 80 parts by mass, respectively, based on 100 parts by mass of the overall rubber component.

Comparative Example 1

A rubber composition was prepared and a developing roller was produced in substantially the same manner as in Example 1, except that the proportion of the ECO was 60 parts by mass and the proportion of the NBIR was 40 parts by mass. The proportions of the ECO and the NBIR were 60 parts by mass and 40 parts by mass, respectively, based on 100 parts by mass of the overall rubber component.

Comparative Example 2

A rubber composition was prepared and a developing roller was produced in substantially the same manner as in Example 1, except that the proportion of the ECO was 10 parts by mass and the proportion of the NBIR was 90 parts by mass. However, the outer peripheral surface of the developing roller was cracked, so that only the type-A durometer hardness measurement test was performed. The proportions of the ECO and the NBIR were 10 parts by mass and 90 parts by mass, respectively, based on 100 parts by mass of the overall rubber component.

Comparative Example 3

A rubber composition was prepared and a developing roller was produced in substantially the same manner as in Example 1, except that NBR (lower acrylonitrile content NBR JSR N250 SL available from JSR Co., Ltd. and having an acrylonitrile content of 20%) was blended instead of the NBIR in the same proportion. The proportions of the ECO and the NBR were 30 parts by mass and 70 parts by mass, respectively, based on 100 parts by mass of the overall rubber component.

Example 4

A rubber composition was prepared and a developing roller was produced in substantially the same manner as in Example 1, except that GECO (EPION (registered trade name) 301 available from Osaka Soda Co., Ltd. and having a molar ratio of EO/EP/AGE=73/23/4) was blended instead of the ECO in the same proportion. The proportions of the GECO and the NBIR were 30 parts by mass and 70 parts by mass, respectively, based on 100 parts by mass of the overall rubber component.

Example 5

A rubber composition was prepared and a developing roller was produced in substantially the same manner as in Example 4, except that 2.00 parts by mass of 2,4,6-trimercapto-s-triazine (triazine crosslinking agent ACTOR (registered trade name) TSH available from Kawaguchi Chemical Industry Co., Ltd.) based on 100 parts by mass of the overall rubber component was blended instead of the thiourea crosslinking agent and the accelerating agent DT. The proportions of the GECO and the NBIR were 30 parts by mass and 70 parts by mass, respectively, based on 100 parts by mass of the overall rubber component.

Example 6

A rubber composition was prepared and a developing roller was produced in substantially the same manner as in Example 1, except that the proportions of the ECO and the NBIR were 20 parts by mass and 50 parts by mass, respectively, and 30 parts by mass of BR (JSR BR01 available from JSR Co., Ltd. and having a cis-1,4 bond content of 95 mass %) was further blended. The proportions of the ECO and the NBIR were 20 parts by mass and 50 parts by mass, respectively, based on 100 parts by mass of the overall rubber component.

Example 7

A rubber composition was prepared and a developing roller was produced in substantially the same manner as in Example 2, except that EPICHLOMER (registered trade name) C available from Osaka Soda Co., Ltd. and having a molar ratio of EO/EP=40/60 was blended as the ECO in the same proportion. The proportions of the ECO and the NBIR were 50 parts by mass and 50 parts by mass, respectively, based on 100 parts by mass of the overall rubber component.

<Measurement of Type-A Durometer Hardness>

The type-A durometer hardness of each of the roller bodies of the developing rollers produced in Examples and Comparative Examples was measured in an ordinary temperature and ordinary humidity environment at a temperature of 23° C. at a relative humidity of 55% by the aforementioned measurement method.

<Measurement of Roller Resistance>

The roller resistance of each of the developing rollers produced in Examples and Comparative Examples was measured in an ordinary temperature and ordinary humidity environment at a temperature of 23° C. at a relative humidity of 55% by the aforementioned measurement method. In the following tables, the roller resistance is shown in the form of log R value.

<Actual Machine Test>

(Initial Image Evaluation)

The developing rollers produced in Examples and Comparative Examples were each set in place of an original developing roller of a toner cartridge of a multifunction machine (imageRUNNER (registered trade name) C5050 available from Canon Inc.)

Immediately after the toner cartridge was set in the multifunction machine, a halftone image and a solid image were formed in an ordinary temperature and ordinary humidity environment at a temperature of 23° C. at a relative humidity of 55%, and visually checked. A developing roller free from defective image formation was rated as excellent (○), and a developing roller suffering from slight defective image formation was rated as acceptable (Δ). A developing roller suffering from apparent defective image formation was rated as unacceptable (×).

(Evaluation For Wear Resistance)

The developing rollers produced in Examples and Comparative Examples were each incorporated in a toner cartridge, which was in turn mounted in the aforementioned multifunction machine, and then 1,500 images were continuously formed. The image formation and a cleaning blade of the multifunction machine were observed, and the roller body of the developing roller was evaluated for wear resistance on the following criteria:

○ (Acceptable wear resistance): During the continuous formation of 1,500 images, neither the abnormality of the cleaning blade due to the wear of the roller body nor the associated defective image formation occurred.

× (Unacceptable wear resistance): During the continuous formation of 1,500 images, the cleaning blade of the multifunction machine was torn up or reversed due to wear debris generated by the wear of the roller body, and the associated defective image formation occurred.

The results are shown in Tables 2 and 3.

TABLE 2

| | | Comparative Example 1 | Example 2 | Example 1 | Example 3 | Comparative Example 2 |
|---|---|---|---|---|---|---|
| | | Parts by mass | | | | |
| Rubber component | ECO | 60 | 50 | 30 | 20 | 10 |
| | GECO | — | — | — | — | — |
| | NBIR | 40 | 50 | 70 | 80 | 90 |
| | BR | — | — | — | — | — |
| | NBR | — | — | — | — | — |
| Sulfur crosslinking component | Sulfur powder | 1.50 | 1.50 | 1.50 | 1.50 | 1.50 |
| | Accelerating agent DM | 1.50 | 1.50 | 1.50 | 1.50 | 1.50 |
| | Accelerating agent TS | 0.50 | 0.50 | 0.50 | 0.50 | 0.50 |
| Thiourea crosslinking agent | | 0.60 | 0.60 | 0.60 | 0.60 | 0.60 |
| Accelerating agent DT | | 0.54 | 0.54 | 0.54 | 0.54 | 0.54 |
| Triazine crosslinking agent | | — | — | — | — | — |
| | | Evaluation | | | | |
| Cracking of outer peripheral surface | | No | No | No | No | Yes |
| Type-A hardness | | 51 | 52 | 56 | 56 | 57 |
| Roller resistance (log R) | | 6.2 | 6.3 | 6.7 | 6.6 | — |
| Actual machine test | Initial image | ○ | ○ | ○ | ○ | — |
| | Wear resistance | x*1 | ○ | ○ | ○ | — |

TABLE 3

| | | Example 4 | Example 5 | Example 6 | Example 7 | Comparative Example 3 |
|---|---|---|---|---|---|---|
| | | Parts by mass | | | | |
| Rubber component | ECO | — | — | 20 | 50*2 | 30 |
| | GECO | 30 | 30 | — | — | — |
| | NBIR | 70 | 70 | 50 | 50 | — |
| | BR | — | — | 30 | — | — |
| | NBR | — | — | — | — | 70 |
| Sulfur crosslinking component | Sulfur powder | 1.50 | 1.50 | 1.50 | 1.50 | 1.50 |
| | Accelerating agent DM | 1.50 | 1.50 | 1.50 | 1.50 | 1.50 |
| | Accelerating agent TS | 0.50 | 0.50 | 0.50 | 0.50 | 0.50 |
| Thiourea crosslinking agent | | 0.60 | — | 0.60 | 0.60 | 0.60 |
| Accelerating agent DT | | 0.54 | — | 0.54 | 0.54 | 0.54 |
| Triazine crosslinking agent | | — | 2.00 | — | — | — |
| | | Evaluation | | | | |
| Cracking of outer peripheral surface | | No | No | No | No | No |
| Type-A hardness | | 55 | 54 | 56 | 57 | 53 |
| Roller resistance (log R) | | 6.5 | 6.4 | 6.8 | 7.5 | 6.8 |
| Actual machine test | Initial image | ○ | ○ | ○ | Δ*3 | ○ |
| | Wear resistance | ○ | ○ | ○ | ○ | x*4 |

Note for Tables 2 and 3 is as follows:

*1When 800th to 900th images were formed, the reversal of the cleaning blade and the defective image formation occurred.

*2This ECO had a molar ratio of EO/EP = 40/60, and the other ECO had a molar ratio of EO/EP = 61/39.

*3Because of a higher roller resistance, slight spot image defect occurred.

*4When 200th to 300th images were formed, the reversal of the cleaning blade and the defective image formation occurred.

The results for Examples 1 to 7 and Comparative Example 3 shown in Tables 2 and 3 indicate that, where the NBIR is used instead of the NBR as the diene rubber, the roller body has an improved wear resistance, thereby preventing the reversal of the cleaning blade and the associated defective image formation which may otherwise occur due to wear debris generated during repeated image formation.

The results for Examples 1 to 6 and Comparative Example 1 indicate that the proportion of the ECO and/or the GECO should be not greater than 50 parts by mass and the proportion of the NBIR should be not less than 50 parts by mass based on 100 parts by mass of the overall rubber component in order to provide the aforementioned effect.

The results for Examples 1 to 6 and Comparative Example 2 indicate that the proportion of the ECO and/or the GECO should be not less than 20 parts by mass and the proportion of the NBIR should be not greater than 80 parts by mass based on 100 parts by mass of the overall rubber component in order to sufficiently reduce the roller resistance of the developing roller to the range suitable for the developing roller while preventing the cracking of the roller body.

Particularly, the results for Examples 2 and 6 indicate that other diene rubber may be used in a proportion of not greater than 30 parts by mass based on 100 parts by mass of the overall rubber component in combination with the NBIR.

The results for Examples 1, 4 and 5 indicate that either the ECO or the GECO is usable as the ion conductive rubber, and either the thiourea crosslinking agent plus the accelerating agent or the triazine crosslinking agent is usable in combination with the sulfur crosslinking component.

The results for Examples 2 and 7 indicate that the ECO to be used as the ion conductive rubber particularly preferably has an ethylene oxide content of not less than 50 mol % and not greater than 80 mol % and an epichlorohydrin content of not less than 20 mol % and not greater than 50 mol % in order to sufficiently reduce the roller resistance of the developing roller for proper image formation.

This application corresponds to Japanese Patent Application No. 2016-182041 filed in the Japan Patent Office on Sep. 16, 2016, the disclosure of which is incorporated herein by reference in its entirety.

What is claimed is:

1. A developing roller comprising:

a tubular roller body comprising a crosslinked product of a rubber composition; and an oxide film provided in an outer peripheral surface of the roller body;

wherein the rubber composition comprises a rubber component, and a crosslinking component for crosslinking the rubber component;

wherein the rubber component comprises not less than 20 parts by mass and not greater than 50 parts by mass of at least one ion conductive rubber selected from the group consisting of an epichlorohydrin-ethylene oxide bipolymer and an epichlorohydrin-ethylene oxide-allyl glycidyl ether terpolymer, and not less than 50 parts by mass and not greater than 80 parts by mass of acrylonitrile butadiene isoprene rubber based on 100 parts by mass of the overall rubber component.

2. The developing roller according to claim 1, wherein the crosslinking component comprises a sulfur crosslinking component, and at least one selected from the group consisting of a thiourea crosslinking agent and a triazine crosslinking agent.

3. The developing roller according to claim 2, wherein the epichlorohydrin-ethylene oxide bipolymer is a copolymer having an ethylene oxide content of not less than 50 mol % and not greater than 80 mol %, and an epichlorohydrin content of not less than 20 mol % and not greater than 50 mol %.

4. The developing roller according to claim 2, wherein the epichlorohydrin-ethylene oxide-allyl glycidyl ether terpolymer is a copolymer having an ethylene oxide content of not less than 71 mol % and not greater than 79.5 mol %, an epichlorohydrin content of not less than 20 mol % and not greater than 24 mol %, and an allyl glycidyl ether content of not less than 0.5 mol % and not greater than 5 mol %.

5. The developing roller according to claim 1, wherein the epichlorohydrin-ethylene oxide bipolymer is a copolymer having an ethylene oxide content of not less than 50 mol % and not greater than 80 mol %, and an epichlorohydrin content of not less than 20 mol % and not greater than 50 mol %.

6. The developing roller according to claim 1, wherein the epichlorohydrin-ethylene oxide-allyl glycidyl ether terpolymer is a copolymer having an ethylene oxide content of not less than 71 mol % and not greater than 79.5 mol %, an epichlorohydrin content of not less than 20 mol % and not greater than 24 mol %, and an allyl glycidyl ether content of not less than 0.5 mol % and not greater than 5 mol %.

* * * * *